US010344442B2

(12) United States Patent
Elmer

(10) Patent No.: US 10,344,442 B2
(45) Date of Patent: Jul. 9, 2019

(54) DEVICE FOR REDUCING UNDERWATER SOUND

(71) Applicant: Karl-Heinz Elmer, Neustadt am Ruebenberge (DE)

(72) Inventor: Karl-Heinz Elmer, Neustadt am Ruebenberge (DE)

(73) Assignee: Karl-Heinz Elmer, Neustadt am Ruebenberge (DE)

( * ) Notice: Subject to any disclaimer, the term of this patent is extended or adjusted under 35 U.S.C. 154(b) by 0 days.

(21) Appl. No.: 15/672,316

(22) Filed: Aug. 9, 2017

(65) Prior Publication Data

US 2017/0356155 A1 Dec. 14, 2017

Related U.S. Application Data

(63) Continuation of application No. 15/124,680, filed as application No. PCT/DE2015/100167 on Apr. 20, 2015, now Pat. No. 9,765,497.

(30) Foreign Application Priority Data

Apr. 25, 2014 (DE) ..... 20 2014 101 958 U

(51) Int. Cl.
*E02D 13/00* (2006.01)
*G10K 11/16* (2006.01)

(52) U.S. Cl.
CPC ..... *E02D 13/005* (2013.01); *G10K 11/16* (2013.01); *E02D 2200/11* (2013.01); *G10K 2200/11* (2013.01)

(58) Field of Classification Search
CPC ... E02D 13/00; E02D 13/005; E02D 2200/11; G10K 11/16
USPC ..... 181/211
See application file for complete search history.

(56) References Cited

U.S. PATENT DOCUMENTS 3,975,918 A * 8/1976 Jansz ..... E02D 13/00 405/232
6,567,341 B2 * 5/2003 Dreyer ..... B63G 13/02 181/296
7,686,539 B2 * 3/2010 Aristaghes ..... E02B 3/06 405/27
8,794,375 B2 * 8/2014 Jung ..... E02D 7/14 181/205
9,488,026 B2 * 11/2016 Wochner ..... E21B 33/10
2008/0006478 A1 1/2008 Dreyer
(Continued)

FOREIGN PATENT DOCUMENTS

DE 102008017418 A1 10/2009
WO WO 2013102459 A1 7/2013

*Primary Examiner* — Jeremy A Luks
(74) *Attorney, Agent, or Firm* — Leydig, Voit & Mayer, Ltd.

(57) ABSTRACT

A device for reducing underwater sound has a holding device and a hydrosound damper with noise reducing elements. The device has a transport housing for transporting the hydrosound damper, a first end of the underwater sound damper being fixed to the transport housing and the transport housing being connected to a holding device via a support device has a cable winch with a support cable arranged on the transport housing and has a motor-driven drum, wherein using the support device, the transport housing is lowered from the holding device to the sea floor.

15 Claims, 6 Drawing Sheets

(56) References Cited

U.S. PATENT DOCUMENTS

| | | | | |
|---|---|---|---|---|
| 2009/0129871 | A1* | 5/2009 | Mohr | E02D 7/02 405/232 |
| 2011/0031062 | A1 | 2/2011 | Elmer | |
| 2012/0097476 | A1 | 4/2012 | Jung et al. | |
| 2012/0298442 | A1* | 11/2012 | Parkin | E02D 13/005 181/290 |
| 2014/0102826 | A1* | 4/2014 | Elmer | E02B 3/062 181/175 |
| 2014/0154015 | A1 | 6/2014 | Jung et al. | |
| 2014/0284139 | A1 | 9/2014 | Elmer | |
| 2015/0078833 | A1 | 3/2015 | Elmer | |

* cited by examiner

DEVICE FOR REDUCING UNDERWATER SOUND

CROSS-REFERENCE TO RELATED APPLICATIONS

This application is a continuation of U.S. application Ser. No. 15/124,680, filed on Sep. 9, 2016, which is a U.S. national stage application under 35 U.S.C. § 371 of International Application No. PCT/DE2015/100167, filed on Apr. 20, 2015, and which claims benefit to German Patent Application No. DE 20 2014 101 958.8, filed on Apr. 25, 2014. The International Application was published in German on Oct. 29, 2015, as WO 2015/161843 A1 under PCT Article 21(2). All of the above applications are hereby incorporated by reference herein.

FIELD

The invention relates to a device for reducing underwater sound.

BACKGROUND

Underwater noise by way of example during offshore pile driving work can be perceived over great distances by marine mammals, by way of example porpoises and seals. Porpoises in particular are affected by underwater noise since with these animals their hearing is used for navigation and searching for food in addition to communication. Permanent damage to their hearing can in the case of these animals consequently lead to their death.

Different techniques are known for reducing the sound. In the case of a bubble curtain compressed air tubes are placed around the underwater construction site. These are connected to compressors and pump compressed air into the tubes on the sea bed. This compressed air rises in the form of a curtain of air bubbles and thus forms a physically acoustically sound-absorbing barrier.

Instead of the air bubbles which are volatile and difficult to regulate, balloons of elastic material can also be used as sound-reducing elements. A plurality of sound-reducing elements is thereby disposed on a support structure. This is by way of example a net which can be stretched flexibly round the source of the sound in the water. The nets are secured on the sea bed by weights. The complete unit of the sound-reducing elements with the support structure is called a hydro sound damper. A hydro sound damper provides additional damping action and can be matched exactly to the anticipated sound spectrum. A hydro sound damper is less susceptible to sea currents and has the optimum effectiveness in the entire relevant frequency range. Furthermore in the case of a hydro sound damper a continuous supply of compressed air is not required, unlike in the case of the bubble curtain.

In order to reduce the hydro sound a hydro sound damper is known from the printed specification DE 10 2008 017 418 A1. This hydro sound damper consists of a plurality of damping elements spaced from one another to reduce the hydro sound and arranged spread out on a support structure, by way of example on a net. The support structure is arranged at the installation site around a source of noise. A source of noise is by way of example a pile which is introduced into the sea bed, which can be achieved by pile driving or boring.

The printed specification WO 2013/102459 A2 describes a method and a device for handling a hydro sound damper in the region of an offshore construction site, more particularly in the case of a pile which is to be introduced into the sea bed. The disclosed device comprises a holding device on which a first end of the hydro sound damper is held, while a second end of the hydro sound damper which is remote from the first end of the hydro sound damper can be positioned movable relative to the holding device, more particularly at a distance from the holding device.

SUMMARY

An aspect of the invention provides a device for reducing underwater sound, the device comprising: a holding device; a hydro sound damper including a support structure and sound-reducing elements attached on the support structure; a transport housing configured to store and transport at least one of the hydro sound dampers which is located in a constricted functioning position, wherein a first end of the hydro sound damper is attached to the transport housing, wherein the transport housing is connected by a support device to the holding device and is movable relative thereto, wherein the support device includes a cable winch including a support cable and/or a motor-driven drum, and wherein the cable winch, the drum, or a combination of two or more of any of these, is assigned to the transport housing.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
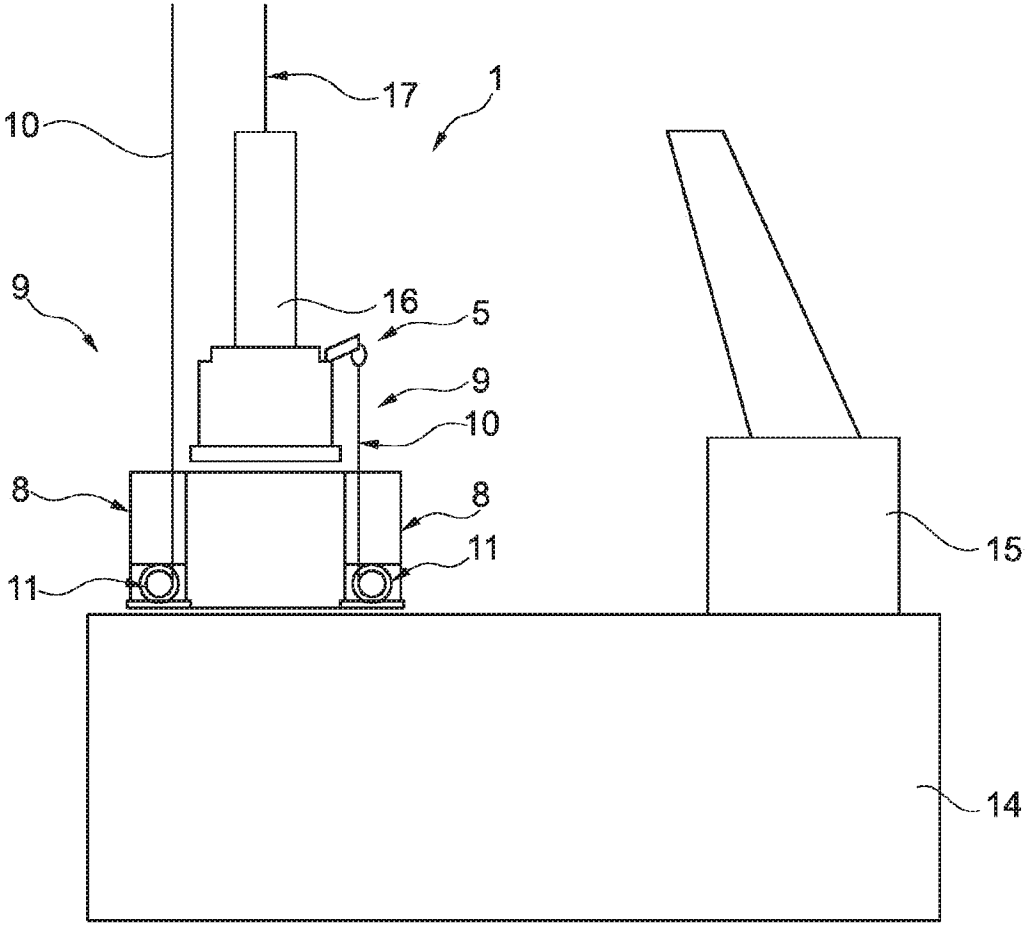
FIG. 1 a diagrammatic illustration of a device according to the invention on a ship.

An aspect of the invention is to further develop the art and to provide the possibility for the arrangement and retrieval of such a device at the installation site to be undertaken rapidly, easily and cost-effectively.

An aspect of the invention is furthermore to minimize the onset or expansion of hydro sound in water, particularly when boring or pile driving a pile into the sea bed.

An aspect of invention relates to a device for reducing underwater sound, by way of example in the area of an offshore construction site, more particularly in the case of a pile which is to be introduced into the sea bed, wherein the device has at least one holding device and at least one hydro sound damper comprising a support structure and sound-reducing elements fixed thereon.

According to an aspect of the invention a device is thus proposed which has a transport housing for storing and transporting at least one hydro sound damper which is located in a constricted functional position wherein a first end of the hydro sound damper is fixed on the transport housing, and the transport housing is connected via a support device to the holding device and is movable relative thereto, wherein the support device comprises at least one cable winch with a support cable or a motor-driven drum, wherein at least one cable winch or the drum is fixed on the transport housing. The stop means of the support cable is connected to the holding device by the arrangement of the drum on the transport housing. Since with this arrangement the hydro sound damper does not slide along the stop means as it is let down and retrieved, it is thereby avoided that this damper, more particularly the support structure which is designed as a net, catches in the stop means. Furthermore this embodiment enables the entire device to be handled more easily and thus better. The reduction of the total mass of the device is achieved in that high-mass mechanisms, such as the drum with the support cable and its drive motor, are fixed on the transport housing and also serve here at the same time as ballast members. Since it is proposed that the weight, more particularly the plunge weight, of the transport housing is greater than the buoyancy force of the hydro sound damper it is expedient to arrange the drum with the support cable and its drive motor on the transport housing. Since the drum is arranged on the transport housing, when the transport housing is let down or lifted up the support cable is not moved relative to the underwater structure. The sound-reducing elements are thereby arranged so that they include between them a sufficient passage for a through-flow. This through-flow direction preferably corresponds to the direction of the sound propagation.

Alternatively to a net the support structure of the hydro sound damper can also be made from a plurality of bodies which are rigid but movable relative to one another. The bodies can be flat frames in the area of which the sound-reducing elements are arranged on grids or nets. The bodies can however also comprise a three-dimensional structure such as cages or containers. For expanding and recovering the hydro sound damper the bodies are moved relative to one another in rotation and/or translation. The packed size of the hydro sound damper is minimized for transport and storage through folding or collapsing.

It is proposed that expanding the hydro sound damper, thus changing over between the first constricted functional positon and a second expanded functional position of the hydro sound damper, takes place either when letting down or drawing up the transport housing or independently of the movement of the transport housing relative to the holding device.

It has proved particularly advantageous that the hydro sound damper has at its first end and/or at its second end and/or at at least one point between the first and the second end a connection means which is arranged movable on the support cable. It is hereby possible that the hydro sound damper, guided by the support cable, can spread out in regulated manner in the vertical direction. As a result of the buoyancy of the hydro sound damper it is possible that it moves up along the support cable as the distance between the holding device and the transport housing increases and thereby extends over the space formed between the holding device and the transport housing. The connection means provide a freedom of movement of the hydro sound damper relative to the support cables which is relatively restricted more particularly in the horizontal direction. It is hereby possible that as the distance between the holding device and the transport housing reduces so the hydro sound damper is automatically dropped down again in the transport housing.

According to a further development of this embodiment it is proposed that a second end of the hydro sound damper is fastened on the holding device. Any fastening indicated in this document is to mean a fastening which can be released before and after use particularly during assembly and dismantling of the device.

More practically it is proposed according to the invention that the holding device is connected to a working apparatus or is held independently of a working apparatus on a crossbar or a gripper. In the case of connection with a working apparatus, by way of example a pile driver for introducing foundation piles into the sea bed, the advantage is gained that the device is simple to handle. The device can be connected onboard a construction ship to the working apparatus and can then together with the working apparatus be lifted by a crane to the operating position. A working apparatus can also be a drilling head. Where the holding device is connected to a crossbar it is possible that the device is independent of a working apparatus. If the working apparatus is a drilling head, then this can be pivoted by way of example in order to change the drilling rod without having to move the device and thus the hydro sound damper. Furthermore the use of the device in the water is also possible if a working apparatus is not to be used immediately, by way of example when blowing up or retrieving ammunition remains in the sea. For use with pile driving work the holder of the device which is separate from the working apparatus on a crossbar or a gripper is particularly advantageous because the holder device is then decoupled from the vibrations and oscillations of the working apparatus. This improves the structure of the device and prevents the formation of sound bridges over the hydro sound damper. The same advantage arises when after setting the device down on the sea bed or on a pile guide located on the sea bed, such as a template, the support cable is held slack.

Pile driving is working with a pile, a working apparatus also called a pile hammer. A typical area of use is driving in piles, for example for pile foundation in the ground. The pile functions on the principle of energy or momentum conservation. Use is made of the fact that the pile is easier to accelerate than the relevant object and mostly has a relatively great deal of mass. There are two different types of pile driving; impact driving and vibration driving. With impact driving the driving material is driven into the ground with repeated individual blows of a drive hammer. The impact energy is generated by a weight which falls down onto the driving material and is additionally accelerated. The kinetic energy acting on the driving material is determined from the mass of the drive hammer and the acceleration obtained thereof. With vibration driving no individual blows are produced in order to introduce the driving material, but a vibration. Vibration hammers are mostly driven hydraulically. Unbalanced weights are mounted on a shaft in the pile hammer housing. Vertically directed vibrations are generated by turning the shafts and the unbalanced weights. The pile driver is set on the driving material. The pile driver and the driving material are connected. The vibrations are transferred through this joint into the driving material.

It is also favorable if the device comprises a further cable winch with a control cable and a motor-driven winder as a deployment unit wherein the second end of the hydro sound damper is fastened to the free end of the control cable and the winder is arranged on the transport housing. The deployment unit enables the transport housing to be let down onto the sea bed by means of the support device from the holding device without the hydro sound damper already spreading out. In a following step the deployment unit is actuated which now enables the uplift of the hydro sound damper in a manner controlled and independent of a movement of the transport housing. Furthermore the positioning of the second end of the hydro sound damper facing the water level can thus be controlled. This control is possible independently of a movement of the holding device, thus independently of the crossbeam or the working apparatus. Thus the hydro sound damper can where necessary be drawn by way of example to several meters below the water level. Also raising up the hydro sound damper into the transport housing can take place independently of the movement of the transport housing. This can be favorable by way of example when interrupting the work due to strong currents or heavy seas. The hydro sound damper is then returned into the transport housing and is thus protected against currents and sea conditions, the device as a whole can however remain in the water for the period of the interruption.

The cable winches of the deployment unit and the support device are preferably underwater winches which are also suitable for use in greater water depths between 30 and 200 meters. The arrangement or fastening of the deployment unit or the support device on the transport housing is to mean a spatial association of the control cable, winder and/or its drive motor or support cable, drum and/or its drive motor to the transport housing. They need not be connected directly to the transport housing in order to be moved with same relative to the holding device.

A particular embodiment proposes that the winder and/or the drum are arranged horizontal next to the transport housing and a guide pulley for the control cable and/or a guide pulley for the support cable is/are provided underneath or on the bottom of the transport housing. It is hereby possible that the hydro sound damper is extended down to the bottom of the transport housing or down to the sea bed.

According to a further development the device has on each side of the hydro sound damper several support cables which are arranged on the transport housing so that they have different distances from the source of the sound or from the underwater structure. Through an alternating connection of the hydro sound damper with at least two support cables which are arranged either side of the hydro sound damper and preferably in a plane orientated transversely to the hydro sound damper it is possible that the hydro sound damper has a spatial thickness. This spatial arrangement of the hydro sound damper improves its effectiveness.

Where the winder and/or drum is positioned underwater the drive can be provided pneumatically. It has been proved particularly effective however if the drive is electric and/or hydraulic.

The transport housing and/or retention unit preferably have boundary walls which are permeable to water. It is thus possible that when lifting the device out from the water the water can rapidly leave the transport housing or retention unit. The transport housing and/or the retention unit are preferably designed as a cage for example with grill-like boundary walls. The boundary surfaces can also be made from perforated boards, by way of example of plastics. It has proved particularly favorable if the boundary faces are made from a net. It is hereby possible to obtain boundary surfaces which do not vibrate or radiate out any sound so that vibrations transferred from the underwater structure to the transport housing cannot be directed onto the surrounding water. A net for a boundary surface can be made with a large mesh size, thus can have a mesh width of 10 cm×10 cm.

The transport housing and the retention unit are designed according to a further embodiment such that they can be arranged inside one another wherein the lateral boundary walls of the transport housing and retention unit overlap in the horizontal direction. The retention unit can hereby be used as a cover for the transport housing.

It has proved convenient if the transport housing and the retention unit each have a receptacle area for the hydro sound damper wherein they have an opening on at least one side and are each aligned with an opening relative to one another for passing through the hydro sound damper.

A special further development of the device comprises a retention unit which is movable independently of the transport housing and relative to the transport housing and to the holding device respectively. The retention unit is thereby preferably arranged movable for guidance on at least one support cable of the transport housing. The movement of the retention unit is achieved through a separate cable whose drive is arranged on the holding device or on the transport housing.

According to a favorable embodiment noise reducing elements are arranged on at least one of the sides and/or outer sides of the retention unit and/or the transport housing. The device hereby achieves a sound reduction spread out along its entire vertical extension in the water.

For deploying the hydro sound damper on an underwater structure it has proved suitable if the holding device and/or the transport housing comprise(s) several, more particularly at least three support devices which are mounted movable on the holding device and/or on the transport housing and can be deflected by means of a spring element against an underwater structure. An underwater structure can be by way of example a construction, a pile, a ship's hull or a rock. The support devices are preferably spread out around the periphery of the underwater structure. As a result of the support devices the device maintains a uniform distance from the underwater structure and is arranged by way of example concentric with a pile. This is particularly advantageous when overcoming obstacles or in the case of conically formed piles. At the ends facing the underwater structure the support devices preferably have roller bodies in order to facilitate the movement along the underwater structure. As a result of the elastically mounted support devices the working apparatus, underwater structure and device are also protected against reciprocal damage.

A preferred embodiment of the support device is a swing arm orientated vertically, thus parallel to the underwater structure and whose one end is provided with a sliding or roller body which bears against the underwater structure. The second end of the swing arm is attached for articulated movement to the device. This connection can be a restraint in the case of an elastic swing rod, but is preferably a rotationally movable articulated bearing. A large deflection of the sliding or roller body with a simultaneously small spring path of the spring element is achieved if the spring element is arranged close to or in the connecting point between the swing rod and the device.

The essential structural parts of a device of this kind, more particularly the holding device and/or the retention unit and/or the transport housing consist of hollow body structures, by way of example pipes. It has thereby proved advantageous if the hollow body structures of the holding device and/or the retention unit and/or the transport housing are filled in their internal spaces with a damping agent and/or with sound reducing elements. A transfer or even intensification of the hydro sound is hereby reduced or prevented through the hollow body structures. The damping agent has a high damping capacity and is by way of example an elastic foam or a viscous mass such as bitumen. It has proved particularly favorable if the damping agent consists of a non- or only insignificantly compressible fluid, by way of example water or oil, and a loose bulk or free-flowing solid material, by way of example sand, which cannot dissolve in this fluid, and represents a viscous substance. It is thereby particularly favorable that the solid material is present in a uniform particle size, by way of example as quartz sand. Compacting of the solid material or damping agent is hereby prevented.

The body vibration which is introduced into this hollow body or is generated in the hollow body is damped through a hollow body structure in which at least one interior space of the hollow body structure is filled with a damping agent and/or with sound reducing elements. An intensification or transmission of the vibration is hereby reduced or prevented. The interior space which is filled with the damping agent is separated from the surrounding water by a single wall. The interior space which is filled with the damping agent, particularly in the case of a hollow body structure having several interior spaces separated from one another, is thus the interior space which is on the outside towards the water.

A damping device is preferably provided which consists of an elastic closed-pore foam material whose pores are filled with a compressible material wherein the damping device is arranged on the pile-driving hammer or in the contact region between the pile-driving hammer and an object which is to be treated by the pile-driving hammer. When driving a pile having a circular cross section the damping device preferably has the shape of a ring which is positioned in the contact region of the hammer and pile, thus at the upper end of the pile or on the underside of the hammer, and encloses the pile on the sleeve side.

During pile driving, the driving hammer is moved downwards by about 1 cm within about 0.01 s. Normally the water located at the ring-shaped lower edge of the driving hammer projecting out beyond the pile is displaced suddenly by this movement, wherein a hydro sound wave is produced. A soft elastic ring of foam material as the damping device arranged underneath the driving hammer, and/or around the pile, absorbs this sudden movement because it is compressed between the water and the driving hammer. The damping device then expands again and discharges the absorbed motion energy slowly and decreasingly to the water during elastic resetting.

A particular embodiment proposes that the ring-shaped damping device is buoyed up. The internal diameter of the damping device thereby corresponds to the pile diameter and/or the external diameter of the damping device corresponds to the diameter of the pile-driving hammer. With a pile diameter of for example 6 m a cross-sectional area of about 30 cm×30 cm is provided for the damping device. The damping device can be connected to the retention unit and on reaching the pile-driving hammer prevents the retention unit from rising further up.

The figures show a device 1 for reducing underwater sound and/or for handling at least one hydro sound damper 2, more particularly in the case of an underwater structure 4. In the illustrated embodiment the device 1 is used in the region of an offshore construction side, more particularly in the case of a pile 4 to be introduced into the sea bed 3 as an underwater structure. The device 1 consists at least of a holding device 5 and at least one hydro sound damper 2 wherein the hydro sound damper 2 comprises a support structure 6 and sound-reducing elements 7 attached thereon. The device 1 consists furthermore of a transport housing 8 for storing and transporting at least one hydro sound damper 2 which is located in a constricted first functioning position. A first end of the hydro sound damper 2 is attached to the transport housing 8. The transport housing 8 is connected to the holding device 5 by way of a support device 9 and is movable relative to the support device 9. The support device 9 comprises at least several cable winches, each having a support cable 10 and a motor-driven drum 11. The drums 11 are attached to the transport housing 8, and are provided for use in the water 12. The hydro sound damper 2 has several connection means 13 which are arranged movable on the support cable 10. Since the drum 11 is positioned in the water 12, more particularly on or underneath the transport housing 8, the connection means 13 cannot hook on the free end of the support cable 10 by the fastening fitment. A problem-free and unimpeded movement of the hydro sound damper 2 along the support cable 10 is thus possible.

FIG. 1 shows the device 1 on a ship 14. The device 1 is set down on the ship 14 before or after use. The ship 14 has a crane 15 by means of which the device 1 is lifted at the installation site in the water 12 and is also retrieved therefrom again. A crane 15 also serves to move a working apparatus 16 between the water 12 and ship 14. The working apparatus 16 in this embodiment is a pile-driving hammer which drives the pile 4 into the sea bed 3. In order to connect the device 1 to the pile-driving hammer 16 these two are positioned relative to one another wherein the driving hammer 16 is preferably arranged raised on a platform (not shown here) above the device 1.

Figure 2:
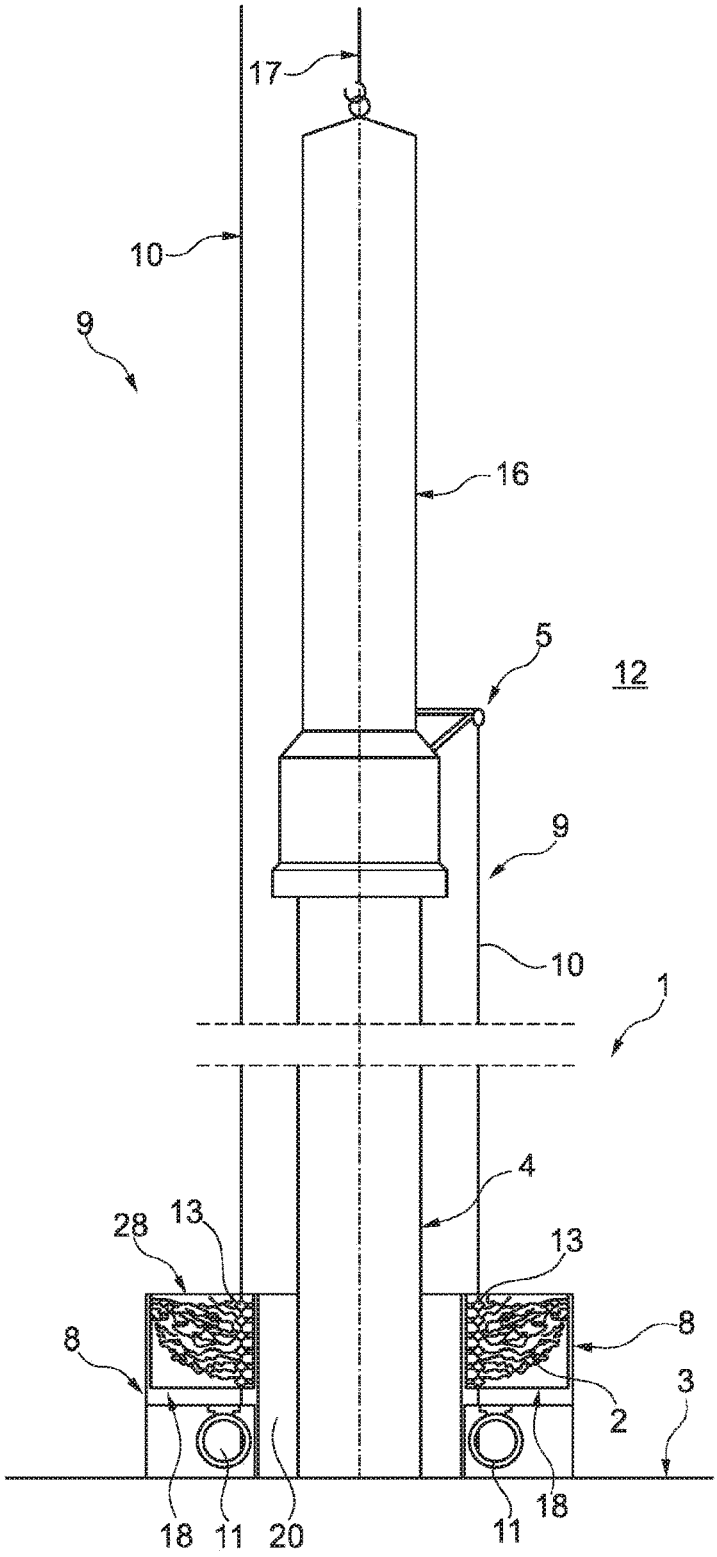
FIG. 2 a diagrammatic illustration of the device shown in FIG. 1, having a hydro sound damper in a first functioning position.
Figure 3:
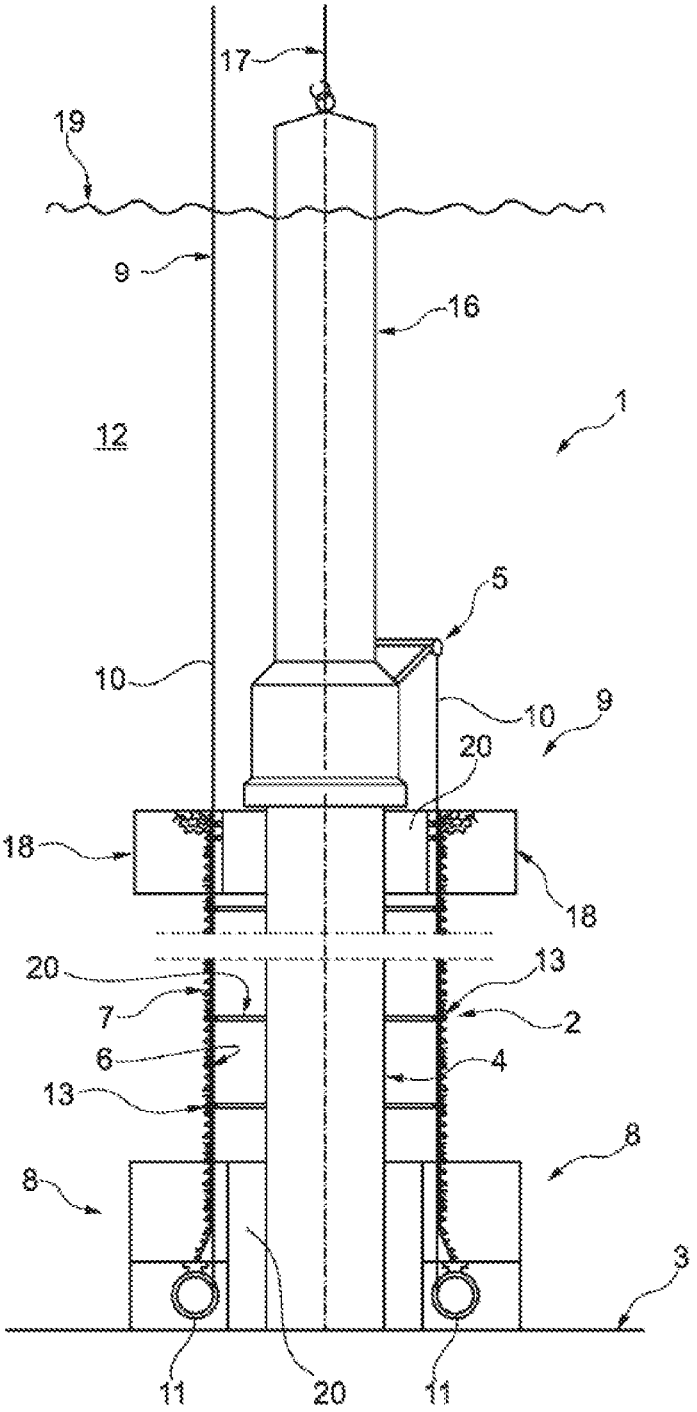
FIG. 3 a diagrammatic illustration of the device shown in FIG. 1 having a hydro sound damper in a second functioning position.

FIGS. 1 to 3 show two different possibilities each as to how the device 1 can be held by the crane 15, particularly during positioning at the installation site. On the right of the figures it is shown that the holding device 5 is connected to the working apparatus 16. The working apparatus 16 and device 1 are hereby moved by the crane 15 from the ship 14 into the water 12 and from the water 12 onto the ship 14. On the left side of the figures it is shown that the holding device 5 is held on the crane 15 independently of the working apparatus 16. The holding device 5 and the working apparatus 16 can thereby be stopped jointly against a crossbar of the crane 15 or against independent crossbars or different cranes 15. A crossbar (not shown here) can also be the holding device 5. Further possibilities which are not shown consist in fastening the free end of the support cable 10 or the holding device 5 on a mechanism for handling the pile 4, such as a gripper or a guide device or a crossbar, or providing the latter as a holding device 5. The pile-driving hammer 16 is connected to the crane 15 by means of a holding cable 17.

FIG. 2 shows the transport housing 8 set down on the sea bed 3. The transport housing 8 is still closed so that the upwardly buoyant hydro sound damper 2 is held in same. The closure of the transport housing 8 is produced by a retention unit 18 positioned in the transport housing 8. The retention unit 18 is mounted movable like the hydro sound damper 2 on the support cable 10. In order to hold the retention unit 18 against the uplift of the hydro sound damper 2 in the transport housing 8 a deployment device is provided, which is not shown in further detail here. The deployment device is a cable winch with a control cable and a motor-driven winder wherein the free end of the control cable is connected to the retention unit 18 and the winder is mounted on the transport housing 8.

FIG. 3 shows the device 1 with a hydro sound damper 2 in a second expanded functioning position. The hydro sound damper 2 reaches this functioning position through actuating the deployment unit 18, thus the deployment unit 18 is let go to follow the uplift of the hydro sound damper 2 until the retention unit is positioned on the working apparatus 16. Alternatively it is possible, particularly when the device 1 stops against the crane 15, shown on the left, that the retention unit 18 rises up past the driving hammer 16 up to the water surface 19. The device 1, more particularly the closed transport housing 8, can also be lowered to its useful position hanging on the support cable 10 at the same time as the driving hammer 16 or only subsequently past the driving hammer 16. When the device 1 stops against the crane 15 shown on the right-hand side, the retention unit 18 is positioned above, next to or as illustrated below the driving hammer 16. The retention unit 18 can also be fixedly connected to the working apparatus 16 or the holding device 5. For deployment, the transport housing 8 is let down and the hydro sound damper 2 is drawn downwards towards the sea bed 3. Furthermore the illustrated device 1 has several support mechanisms 20. The support mechanisms 20 ensure that the device 1 and more particularly the hydro sound damper 2 are held at a distance from the underwater structure 4. For this purpose several support mechanisms 20 are arranged on the holding device 5, on the connecting means 13 and on the transport housing 8.

Figure 4A:
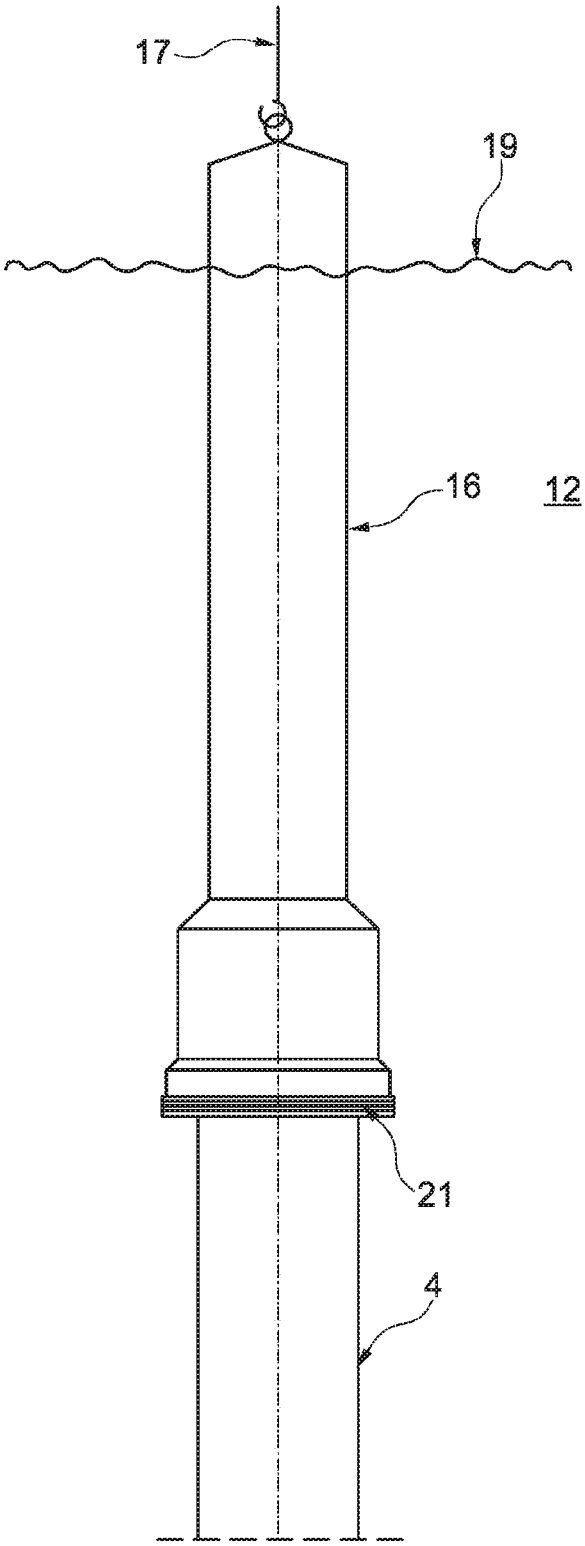
FIG. 4*a* a diagrammatic illustration of a section of the device shown in FIG. 1 with a damping device.
Figure 4B:
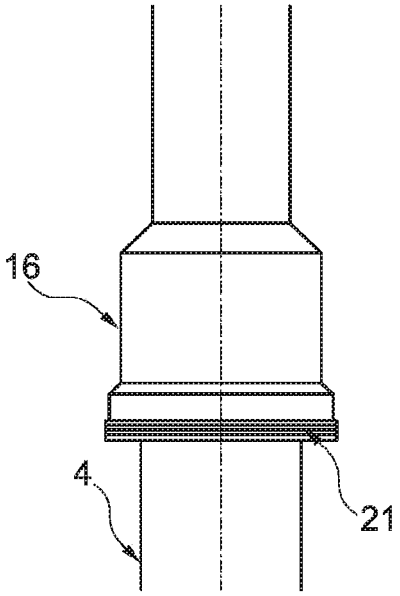
FIG. 4*b* a diagrammatic cross-sectional illustration of a section of the damping device illustrated in FIG. 4*a;*

FIGS. 4*a* and 4*b* each show a damping device 21 for reducing the onset of hydro sound when using a pile-driving hammer 16. In a useful position the damping device 21 surrounds the pile 4 in a ring around the sleeve surface and adjoins the underside of the driving hammer 16 facing the pile 4. The damping device 21 consists of an elastic closed-pore foam material and is connected to the retention unit 18.

Figure 5:
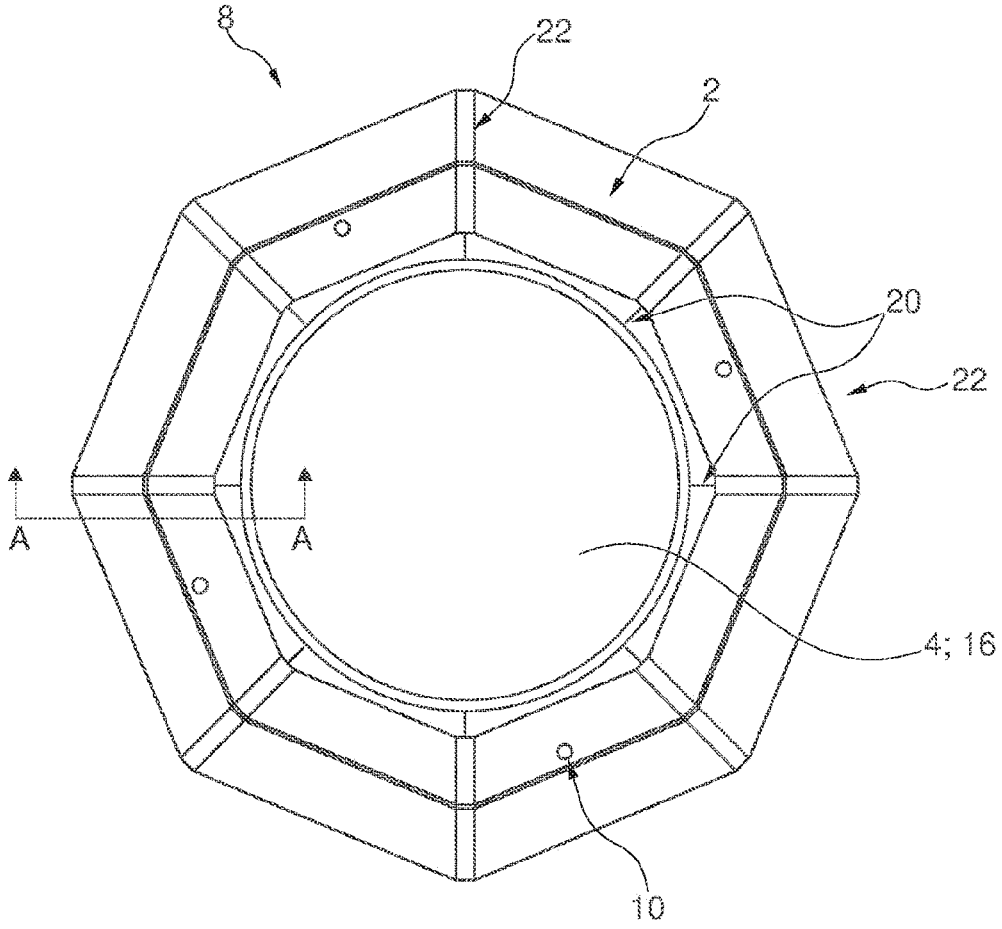
FIG. 5 a diagrammatic illustration of a plan view of a transport housing of the device illustrated in FIG. 1.
Figure 6:
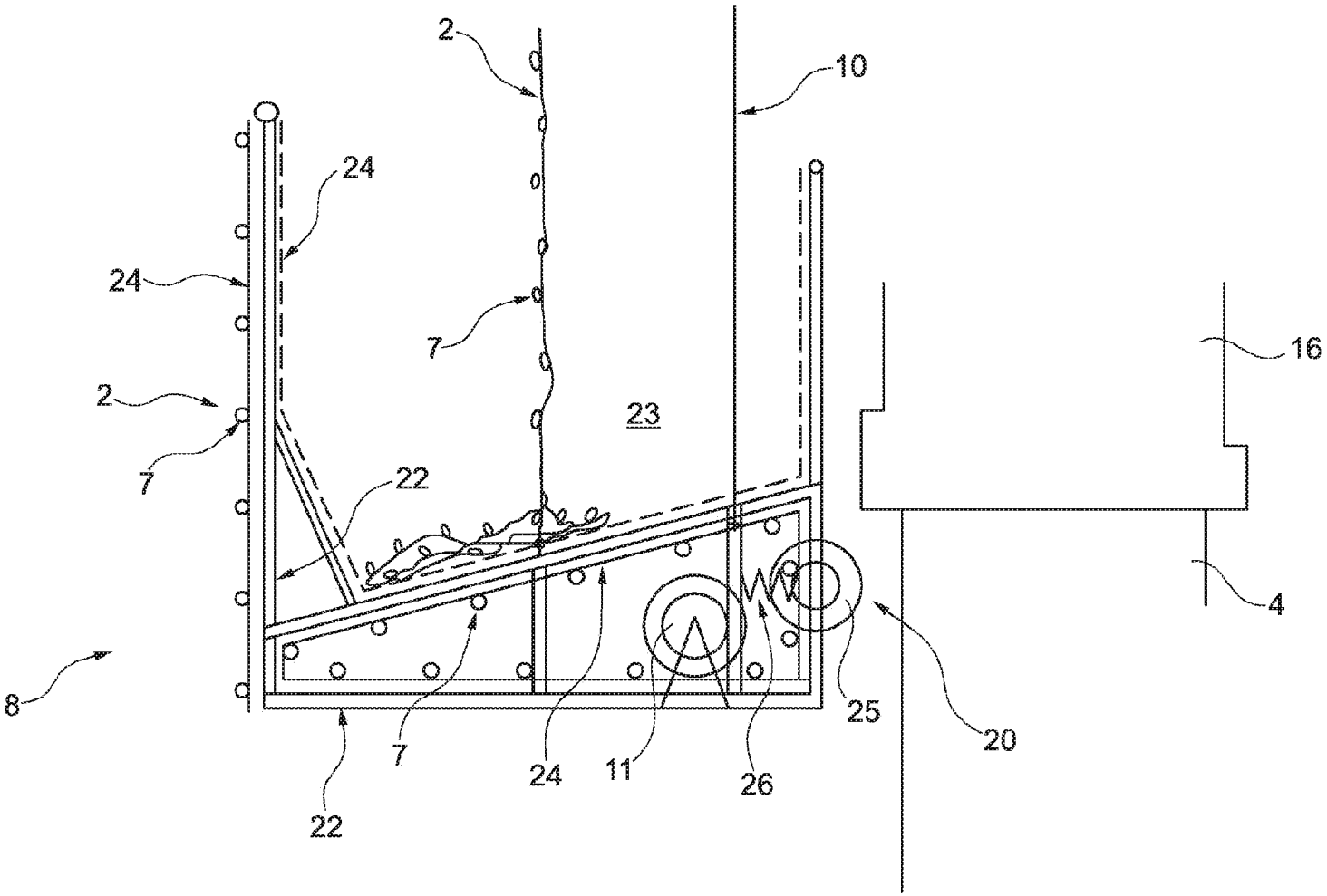
FIG. 6 a diagrammatic cross-sectional view of the transport housing illustrated in FIG. 5.

FIGS. 5 and 6 show the device 1 with a differently configured transport housing 8. FIG. 5 shows the transport housing 8 in a diagrammatic plan view and FIG. 6 shows a cross-sectional view along the line A-A. The transport housing 8 is formed as a ring surrounding the underwater structure 4. The shape of the transport housing 8 is polygonal. The transport housing 8 consists of an open frame support structure comprising hollow bodies, preferably pipes 22. The interior space of the pipes is filled with a damping agent and/or with sound reducing elements.

The transport housing 8 is held by four support cables 10. A drum 11 is provided for each of the support cables 10 wherein the four drums 11 are arranged underneath a receiving area 23 for the hydro sound damper 2. Some, more particularly the outer, braces of the frame support structure are covered by nets 24 having sound reducing elements 7 in the manner of a hydro sound damper 2. In order to avoid the hydro sound damper 2, which is arranged in the receiving area 23, from hooking on the pipes 22 of the frame support structure, the inner boundaries of the receiving area 23 are lined with simple, thus without sound-reducing elements 7, narrow-mesh nets 24.

The illustrated transport housing 8 is provided for use with above-water pile driving. In the case of above-water pile driving, the pile 4 which is to be driven always projects out above the water surface 19. The hydro sound damper 2 which is spread out in the water 12 must not be moved past the working apparatus 16, thus cannot hook on the latter. When the transport housing 8 is raised a hydro sound damper 2 which rises up to the water surface 19 is received without problem in the receiving area 23. Eight support mechanisms 20 are provided here for ensuring a uniform spacing of the transport housing 8 from the pile 4. Each of the support mechanisms 20 consists of a roller body 25 which is mounted elastically on a spring element 26.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

What is claimed is:

1. A device for reducing underwater sound generated by a working apparatus at an installation site and being transportable to the installation site on a sea-going vessel, the device comprising:

a hydro sound damper including an expandable support structure and a plurality of sound reducing elements attached to the support structure, the support structure being deployable in an expanded configuration in which elements of the plurality of sound reducing elements are spaced apart in a hollow tubular arrangement substantially around a work item that is associated with the working apparatus, each element holding a gas therein and being responsive to acoustic energy in the vicinity of the element when the plurality of sound reducing elements is arranged in the expanded configuration in which the elements are spaced farther apart from one another than they are in a stowed, constricted configuration, the support structure including a plurality of spaced cables coupled to a cable winch;

a holding device movable to an operating position relative to the working apparatus, and when in the operating position configured to support the hydro sound damper underwater in the expanded, deployed configuration by supporting one or more of the spaced cables;

a transport housing configured to store and transport at least some of the plurality of sound reducing elements when the hydro sound damper is disposed in the stowed, constricted configuration, wherein each of the spaced cables has a first end attached to the transport housing such that the transport housing is connected to the holding device and is movable relative thereto; and a support device including a cable winch disposed to move the hydro sound damper from the stowed, constricted configuration when the hydro sound damper is being transported to the installation site to the expanded, deployed configuration when the hydro sound damper is located at the installation site.

2. The device for reducing underwater sound as set forth in claim 1, wherein the hollow tubular arrangement is a three-dimensional array.

3. The device for reducing underwater sound as set forth in claim 2, wherein the work item has an elongate shape having one end at least partially submerged in water, wherein the hollow tubular arrangement extends around the one end of the work item, and wherein the work item is a pile.

4. The device for reducing underwater sound as set forth in claim 3, wherein the device for reducing underwater sound includes at least four hydro sound dampers.

5. The device for reducing underwater sound as set forth in claim 1, wherein the holding device is connected to the working apparatus when moved to the operating position.

6. The device for reducing underwater sound as set forth in claim 1, wherein the holding device is held independently of the working apparatus when moved to the operating position.

7. The device for reducing underwater sound as set forth in claim 1, further comprising a retention unit disposed in stacked relation with the transport unit when the hydro sound damper is disposed in the stowed, constricted configuration.

8. The device for reducing underwater sound as set forth in claim 7, wherein the retention unit is moved away from the transport unit when the hydro sound damper is disposed in the expanded, deployed configuration.

9. The device for reducing underwater sound as set forth in claim 8, wherein the transport unit has a substantially rectangular cross section.

10. The device for reducing underwater sound as set forth in claim 9, wherein the retention unit has a substantially rectangular cross section.

11. The device for reducing underwater sound as set forth in claim 1, further comprising:

a deployment unit including a deployment cable winch, a control cable and a motor-driven winder, wherein the hydro sound damper is fastened to a free end of the control cable and wherein the motor-driven winder is arranged on the transport housing.

12. The device for reducing underwater sound as set forth in claim 10, wherein at least one of the plurality of sound reducing elements is arranged on an outer side of the retention unit.

13. The device for reducing underwater sound as set forth in claim 1, wherein the working apparatus operates to drive a pile into the seabed, and wherein the holding device includes a gripper device disposed to handle the pile.

14. The device for reducing underwater sound as set forth in claim 7, wherein the retention unit includes at least one structure filled in its interior spaces with a damping agent.

15. The device for reducing underwater sound as set forth in claim 14, wherein the retention unit has a substantially rectangular cross section.

* * * * *